US009052648B2

(12) United States Patent
Komiyama et al.

(10) Patent No.: US 9,052,648 B2
(45) Date of Patent: Jun. 9, 2015

(54) IMAGE FORMING APPARATUS

(75) Inventors: Tsutomu Komiyama, Kanagawa (JP); Kazutoshi Sugitani, Kanagawa (JP); Yoko Miyamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 1047 days.

(21) Appl. No.: 12/550,644

(22) Filed: Aug. 31, 2009

(65) Prior Publication Data

US 2010/0215420 A1 Aug. 26, 2010

(30) Foreign Application Priority Data

Feb. 23, 2009 (JP) ..... P2009-039152

(51) Int. Cl.

| | |
|---|---|
| ***G03G 21/20*** | (2006.01) |
| ***G03G 15/20*** | (2006.01) |
| ***G03G 15/00*** | (2006.01) |
| ***G03G 21/16*** | (2006.01) |

(52) U.S. Cl.

CPC ..... *G03G 15/20* (2013.01); *G03G 15/657* (2013.01); *G03G 2215/00016* (2013.01); *G03G 2221/1639* (2013.01); *G03G 21/1685* (2013.01)

(58) Field of Classification Search

CPC ..... G03G 2215/00016; G03G 15/657; G03G 2221/1696; G03G 2221/1651; G03G 2221/1639; G03G 21/1685; G03G 21/20; B65H 2301/44322; B65H 29/16; B65H 2301/4473; B65H 2404/2691; B65H 2402/63; B65H 2402/631; B65H 2405/312

USPC ..... 399/400, 107, 110; 400/691, 692, 693; 198/861.1, 861.5, 600

See application file for complete search history.

(56) References Cited

U.S. PATENT DOCUMENTS

| | | | | |
|---|---|---|---|---|
| 4,657,372 | A * | 4/1987 | Ikeda et al. | 399/13 |
| 2002/0163118 | A1* | 11/2002 | Inoue | 271/162 |
| 2007/0145676 | A1* | 6/2007 | Biegelsen et al. | 271/264 |

FOREIGN PATENT DOCUMENTS

| | | | |
|---|---|---|---|
| JP | 9-216758 | | 8/1997 |
| JP | 9-267961 | | 10/1997 |
| JP | 2003-002485 | | 1/2003 |
| JP | 2003-280414 | | 10/2003 |
| JP | 2003280414 | A * | 10/2003 |
| JP | 2005-292564 | | 10/2005 |
| JP | 2005292564 | A * | 10/2005 |

* cited by examiner

*Primary Examiner* — Judy Nguyen
*Assistant Examiner* — Jennifer Simmons
(74) *Attorney, Agent, or Firm* — Sughrue Mion, PLLC

(57) ABSTRACT

An image apparatus includes: a first housing including an image forming unit for forming an image on a recording material; a second housing including a heating unit for heating the formed image; a conveying unit, provided across the first and second housings, that conveys the recording material to a side of the heating unit using a no-end belt; a conveying unit including a first fixed unit disposed on a side of the second housing and a second fixed unit disposed on a side of the first housing; a first fixing unit positioning the first fixed unit to the heating unit, and fixing the first fixed unit to restrict directions other than a rotating direction of the conveying unit around the first fixed unit; a second fixing unit rotating the conveying unit around the first fixed unit, and fixing the second fixed unit to the first housing.

2 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2009-039152 filed on Feb. 23, 2009.

BACKGROUND

1. Technical Field

The present invention relates to an image forming apparatus.

2. Related Art

There is a tendency that a size of an image forming apparatus is increased due to an increase in a speed of an image formation or multicoloring.

SUMMARY

According to an aspect of the invention, an image apparatus includes a first housing, a second housing, a conveying unit, a first fixing unit and a second fixing unit. The first housing includes an image forming unit for forming an image on a recording material. The second housing includes a heating unit for heating the image formed on the recording material. The conveying unit is provided across the first and second housings and conveys the recording material having the image formed thereon to a side of the heating unit using a no-end belt. The conveying unit includes a first fixed unit and a second fixed unit. The first fixed unit is disposed on a side of the second housing of the conveying unit. The second fixed unit is disposed on a side of the first housing of the conveying unit. The first fixing unit positions the first fixed unit with respect to the heating unit, and fixes the first fixed unit to restrict directions other than a rotating direction of the conveying unit around the first fixed unit. The second fixing unit rotates the conveying unit around the first fixed unit fixed to the first fixing unit, and fixes the second fixed unit to the first housing.

BRIEF DESCRIPTION OF THE DRAWINGS

Exemplary embodiments of the present invention will be described in detail based on the following figures, wherein.

DETAILED DESCRIPTION

Figure 1:
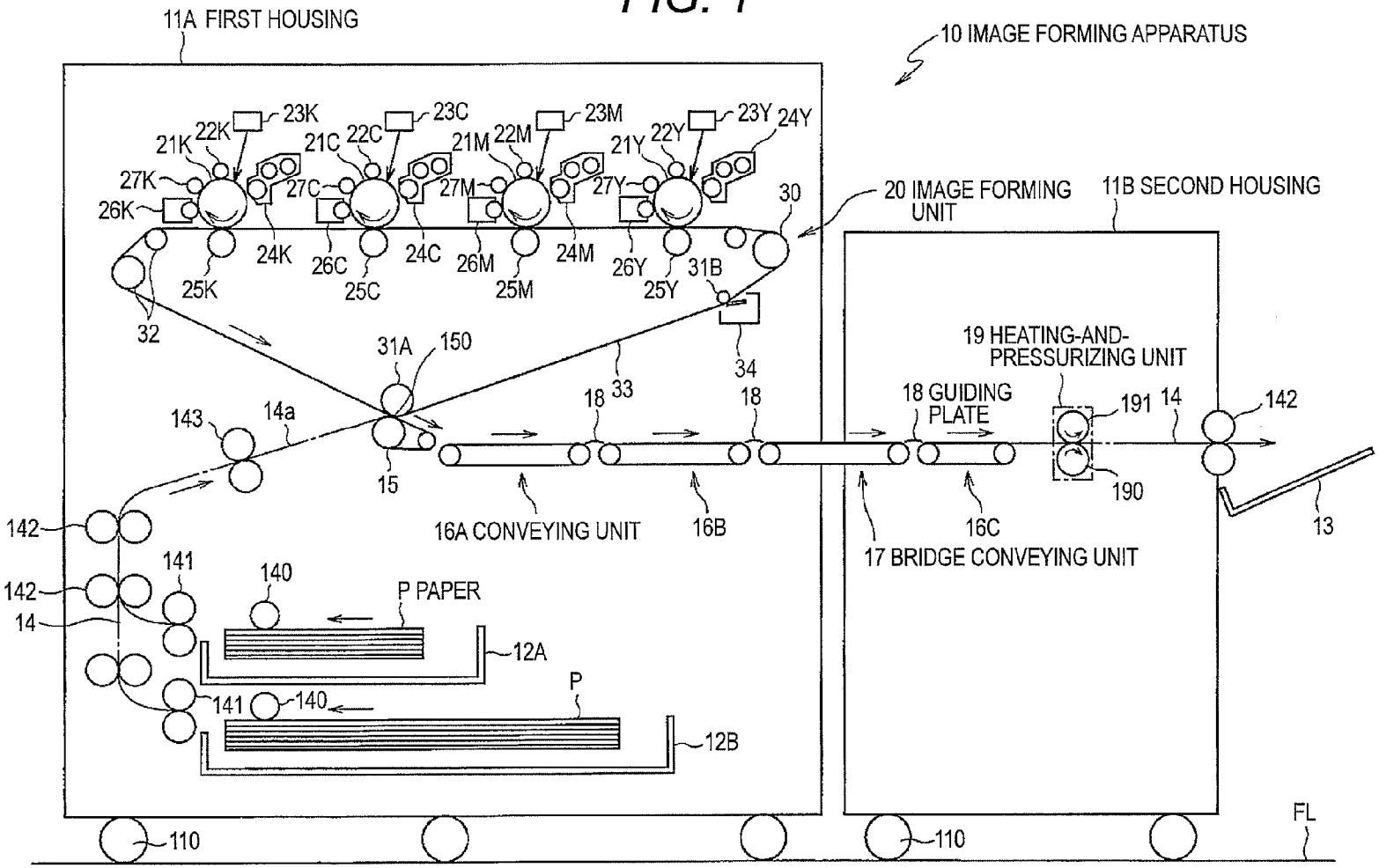
FIG. 1 is a view showing a structure according to an example of an image forming apparatus in accordance with an embodiment of the invention.

FIG. 1 is a view showing a structure according to an example of an image forming apparatus in accordance with an embodiment of the invention. An image forming apparatus 10 is a digital color printer, for example, and has such a structure as to carry out an image processing through an image processing unit (not shown) over image data transmitted from an upper device such as a personal computer and to perform a conversion into image data on respective colors of yellow (Y), magenta (M), cyan (C) and black (K), and to then form a color image on a paper according to an example of a recording material based on the image data on the respective colors. The image forming apparatus 10 may be a copying machine, a facsimile or a composite machine having a plurality of functions of the copying machine, a printer, a scanner and the facsimile. The recording material is not restricted to a paper but may be a resin sheet such as an OHP sheet.

The image forming apparatus 10 includes a first housing 11A which is almost box-shaped and has an image forming unit 20 to be described below, and a second housing 11B which is almost box-shaped and has a heating-and-pressurizing unit 19 to be described below. Each of the housings 11A and 11B has a caster 110 in a lower part. The second housing 11B may be provided with a cooling unit for cooling a paper P or an inversion conveying path for inverting the paper P and conveying the inverted paper P to a registration roll 143 of the first housing 11A which will be described below.

Moreover, the image forming apparatus 10 has paper feeding trays 12A and 12B provided removably on a lower part in the first housing 11A. The paper feeding trays 12A and 12B accommodate the paper P. A discharging tray 13 for discharging the recorded paper P is provided on a side surface of the second housing 11B. A paper conveying path 14 is formed to reach the discharging tray 13 from the paper feeding trays 12A and 12B.

A pickup roll 140 for taking the papers P in one by one from the paper feeding trays 12A and 12B to the paper conveying path 14, a handling roll 141 for handling the paper P taken in by the pickup roll 140, a conveying roll 142 for conveying the paper P, conveying units 16A and 16B, the registration roll 143 to be operated synchronously with a developer image formation timing, and a secondary transferring belt 15 are provided over the paper conveying path 14 in the first housing 11A. A guiding plate 18 is provided between the conveying units 16A and 16B.

In the image forming apparatus 10, moreover, the image forming unit 20 is disposed above the paper feeding trays 12A and 12B in the first housing 11A. The image forming unit 20 includes photosensitive members 21Y, 21M, 21C and 21K on which developer images having the respective colors of the yellow (Y), the magenta (M), the cyan (C) and the black (K) are formed with a rotation in a direction of an arrow in the drawing, charging devices 22Y, 22M, 22C and 22K for uniformly charging surfaces of the photosensitive members 21Y, 21M, 21C and 21K, exposing devices 23Y, 23M, 23C and 23K for forming electrostatic latent images having the respective colors of Y, M, C and K by irradiating, on the charged photosensitive members 21Y, 21M, 21C and 21K, an exposed light which is modulated based on image data on the respective colors of Y, M, C and K, and developing devices 24Y, 24M, 24C and 24K for forming developer images on the surfaces of the photosensitive members 21Y, 21M, 21C and 21K by developing the electrostatic latent images with developers.

The developers for the respective colors are supplied to the developing devices 24Y, 24M, 24C and 24K from developer boxes (not shown) which are provided for the respective colors of Y, M, C and K.

The image forming unit 20 includes photosensitive member cleaning devices 26Y, 26M, 26C and 26K for collecting the developers remaining on the surfaces of the photosensitive members 21Y, 21M, 21C and 21K subjected to a transfer, and antistatic devices 27Y, 27M, 27C and 27K for eliminating charges from the photosensitive members 21Y, 21M, 21C and 21K subjected to the transfer.

Furthermore, the image forming unit 20 includes an intermediate transferring belt 33 provided over a driving roll 30, backup rolls 31A and 31B, and a driven roll 32. The intermediate transferring belt 33 is circulated and moved in the direction of the arrow in the drawing in a contact with the photosensitive members 21Y, 21M, 21C and 21K.

Primary transferring rolls 25Y, 25M, 25C and 25K are provided on an opposite side of the photosensitive members 21Y, 21M, 21C and 21K with the intermediate transferring belt 33 interposed therebetween, and developer images on the surfaces of the photosensitive members 21Y, 21M, 21C and 21K are transferred to the intermediate transferring belt 33 by a pressure contact force and an electrostatic force in nip regions formed between the primary transferring rolls 25Y, 25M, 25C and 25K and the photosensitive members 21Y, 21M, 21C and 21K.

Moreover, the secondary transferring belt 15 is provided on an opposite side of the backup roll 31A with the intermediate transferring belt 33 interposed therebetween, and the developer image on the intermediate transferring belt 33 is secondarily transferred to the paper P in a nip region 150 of a secondary transferring unit formed between the secondary transferring belt 15 and the backup roll 31A.

Furthermore, the image forming unit 20 is provided with a belt cleaning device 34 on an upstream side of the photosensitive member 21Y disposed in a conveying direction of the intermediate transferring belt 33 at an opposite side of the backup roll 31B with the intermediate transferring belt 33 interposed therebetween, and the belt cleaning device 34 is pressed toward the backup roll 31B side to scrape the developer remaining on the intermediate transferring belt 33 away and to collect the developer.

A conveying unit 16C for conveying the paper P, the heating-and-pressurizing unit 19 and the conveying roll 142 are provided on the paper conveying path 14 at the second housing 11B side.

The heating-and-pressurizing unit 19 has a heating roll 190 and a pressurizing roll 191, and fixes the developer image onto the paper P by heat and pressure in a fixing region formed by the heating roll 190 and the pressurizing roll 191.

Moreover, the image forming apparatus 10 includes a bridge conveying unit 17 which is provided across the first housing 11A and the second housing 11B and conveys the paper P having the developer image formed thereon from the conveying unit 16B to the heating-and-pressurizing unit 19 through the conveying unit 16C. The guiding plate 18 is provided between the conveying unit 16B and the bridge conveying unit 17 and between the bridge conveying unit 17 and the conveying unit 16C.

Figure 2A:
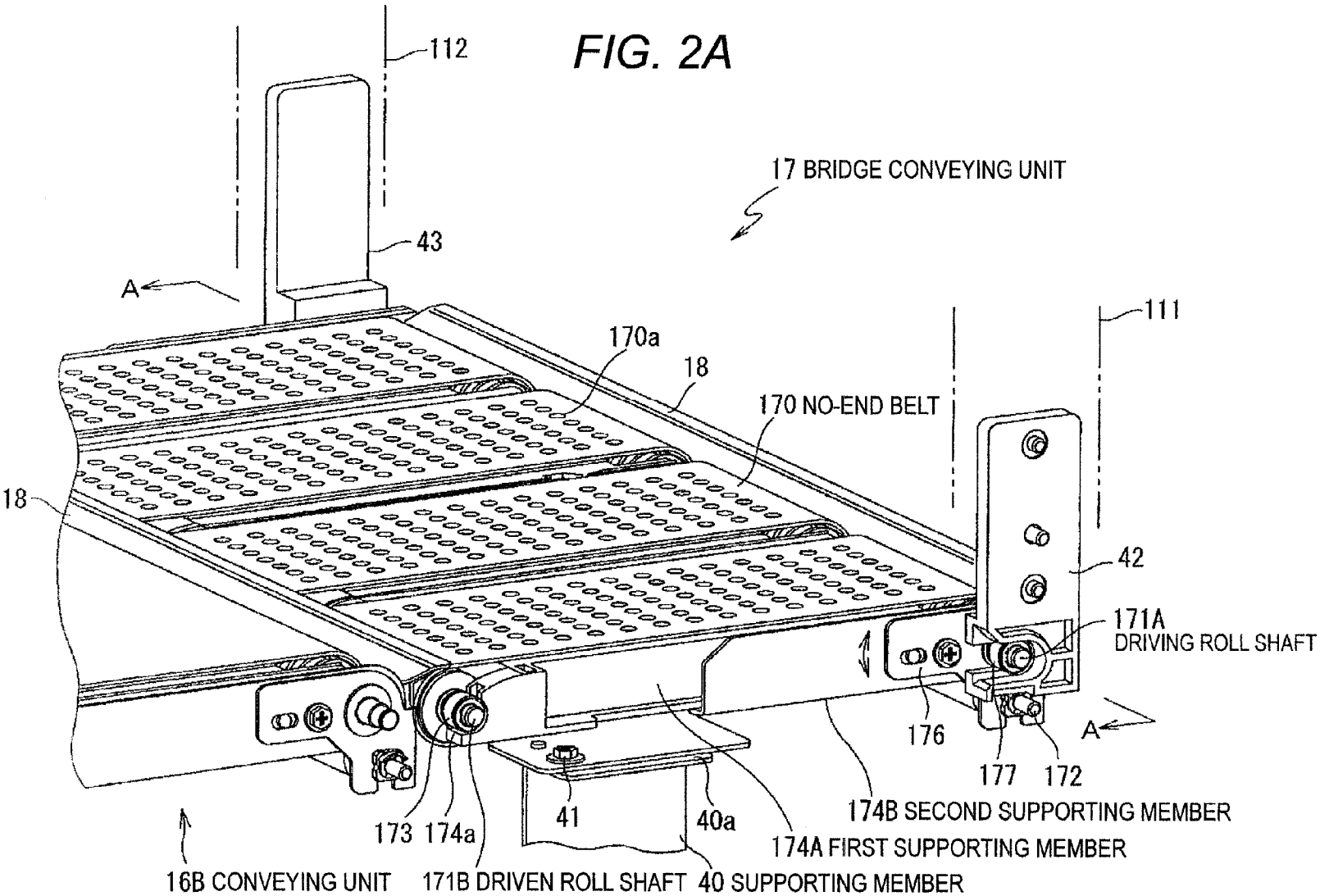
FIG. 2A is a perspective view showing a structure of a bridge conveying unit according to the embodiment of the invention.
Figure 2B:
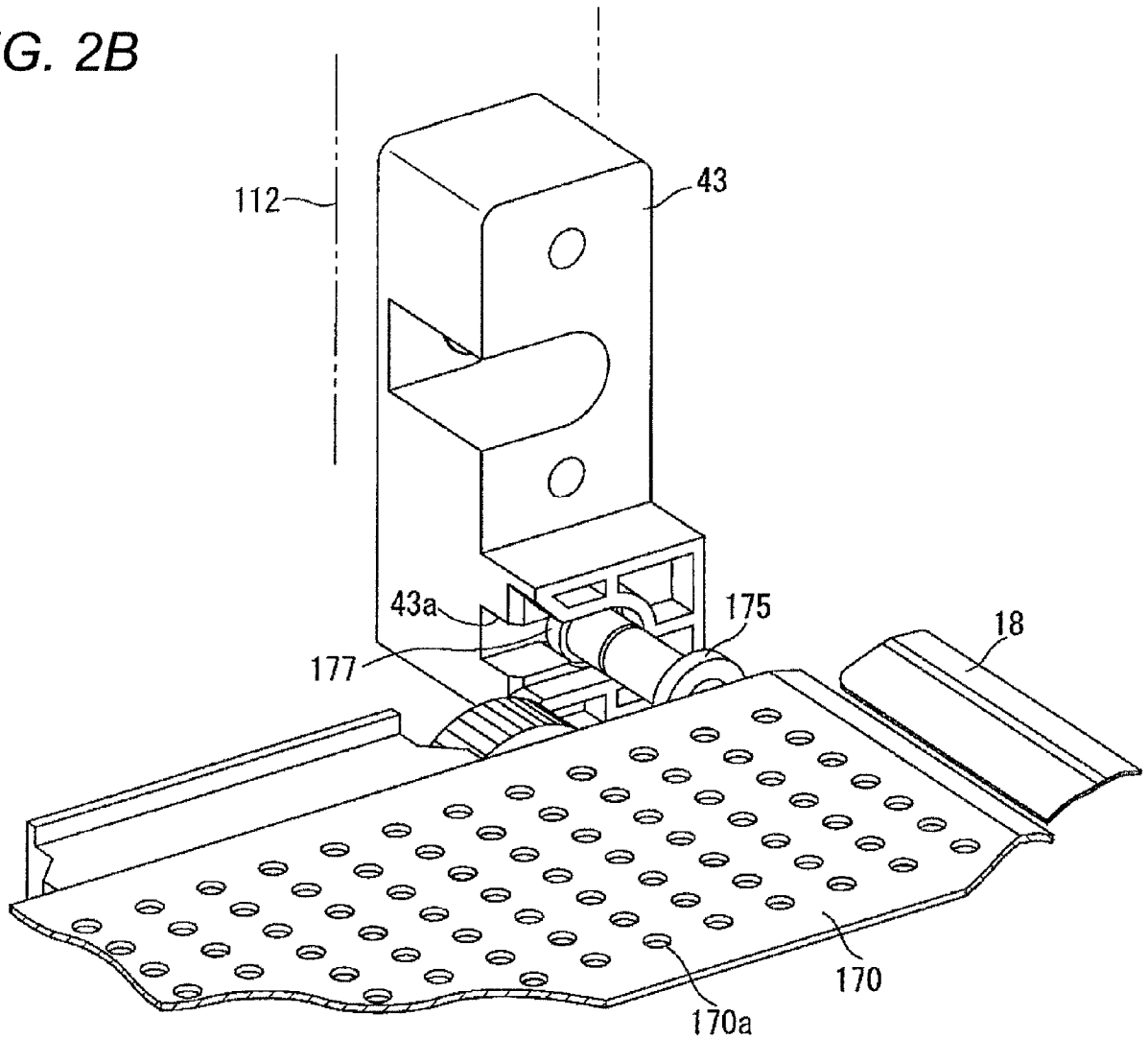
FIG. 2B is a perspective view showing the structure of the bridge conveying unit according to the embodiment of the invention.
Figure 2C:
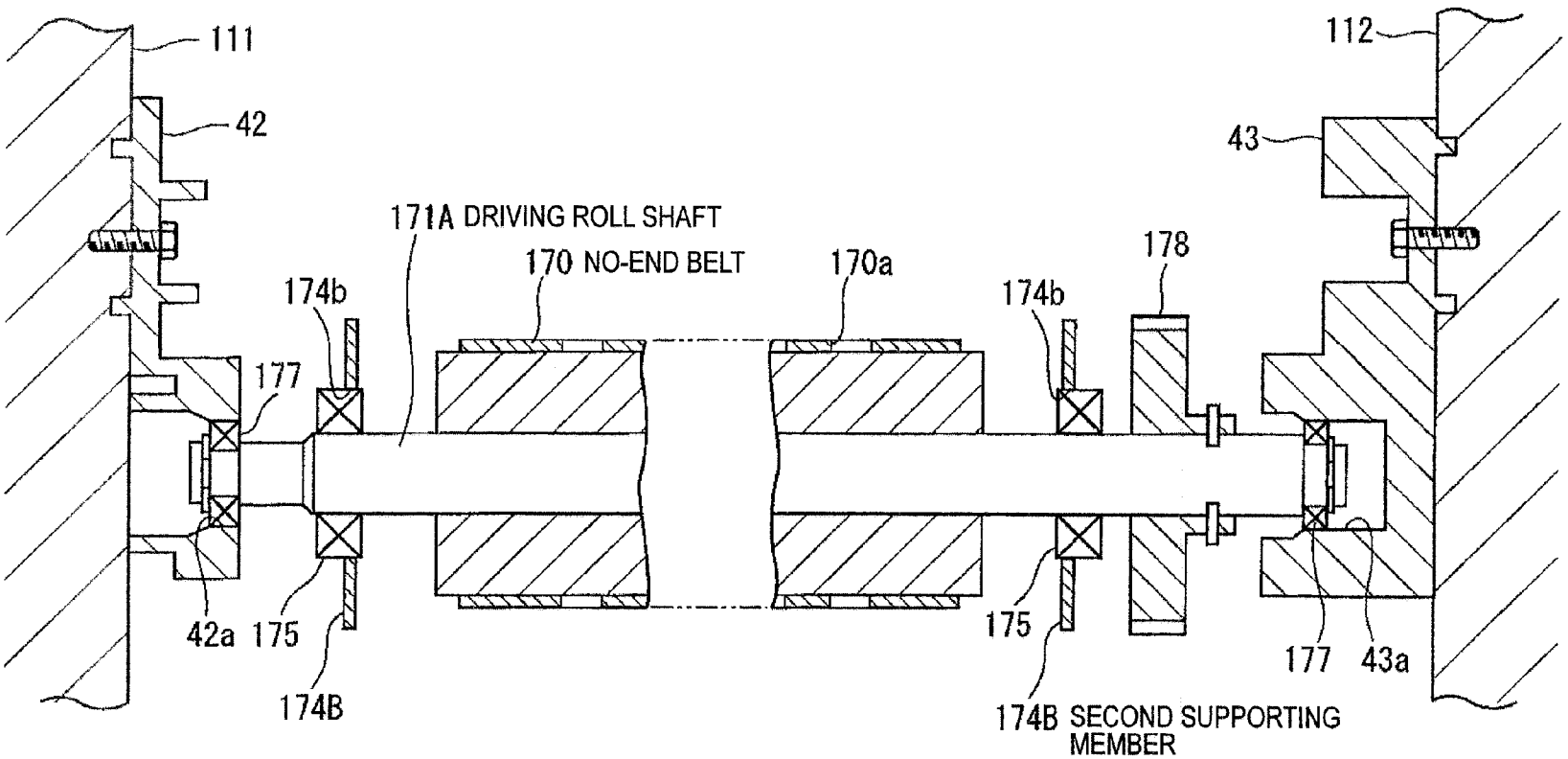
FIG. 2C is a sectional view taken along an A-A line in FIG. 2A.

FIGS. 2A and 2B are perspective views showing a structure of the bridge conveying unit 17 according to the embodiment of the invention, and FIG. 2C is a sectional view taken along an A-A line in FIG. 2A. In FIG. 2B, there are not shown a gear 178 and a second supporting member 174B on an inner side which are illustrated in FIG. 2C.

As shown in FIG. 2A, the bridge conveying unit 17 includes a no-end belt 170, a driving roll shaft 171A serving as an example of a first fixed unit and a driven roll shaft 171B over which the no-end belt 170 is provided, a driving shaft 172 for driving the driving roll shaft 171A through the gear (see FIG. 2C) 178 by means of a motor, a pair of first supporting members 174A provided on both sides of each of the roll shafts 171A and 171B and serving to support the driven roll shaft 171B through a bearing 173, a pair of supporting members 174B serving as an example of second fixed units which are attached to lower surfaces of the respective first supporting members 174A and support the driving roll shaft 171A through a bearing (see FIG. 2C) 175, and a fixing member 176 for fixing the driving shaft 172 to the second supporting member 174B.

A sucking hole 170*a* is formed on the no-end belt 170, and the paper P is sucked through the sucking hole 170*a* by means of a sucking fan which is not shown so that the paper P can be sucked into the no-end belt 170 and can be thus conveyed. Moreover, the other conveying units 16A, 16B and 16C may suck and convey the paper P by using the no-end belt having the sucking hole in the same manner as the bridge conveying unit 17.

A supporting member 40 serving as an example of a second fixing unit is attached to the first housing 11A, and the second supporting member 174B is fixed to an upper surface 40*a* of the supporting member 40 with a bolt 41.

The second housing 11B has blocks 42 and 43 serving as an example of first fixing units which are provided on both sides through a conveying path and are fixed to frames 111 and 112. Vertical and horizontal directions of each of the blocks 42 and 43 are positioned with respect to the heating-and-pressurizing unit 19.

The first supporting member 174A has a bearing unit 174*a* formed thereon. The bearing unit 174*a* serves to hold the bearing 173 provided on the driven roll shaft 171B. The second supporting member 174B has a bearing unit (see FIG. 2C) 174*b* formed thereon. The bearing unit 174*b* serves to hold the bearing (see FIG. 2C) 175 provided on the driving roll shaft 171A.

Bearings 177 are attached to both ends of the driving roll shaft 171A and are held on bearing units 42*a* and 43*a* (see FIGS. 2B and 2C) formed on the blocks 42 and 43.

Figure 3:
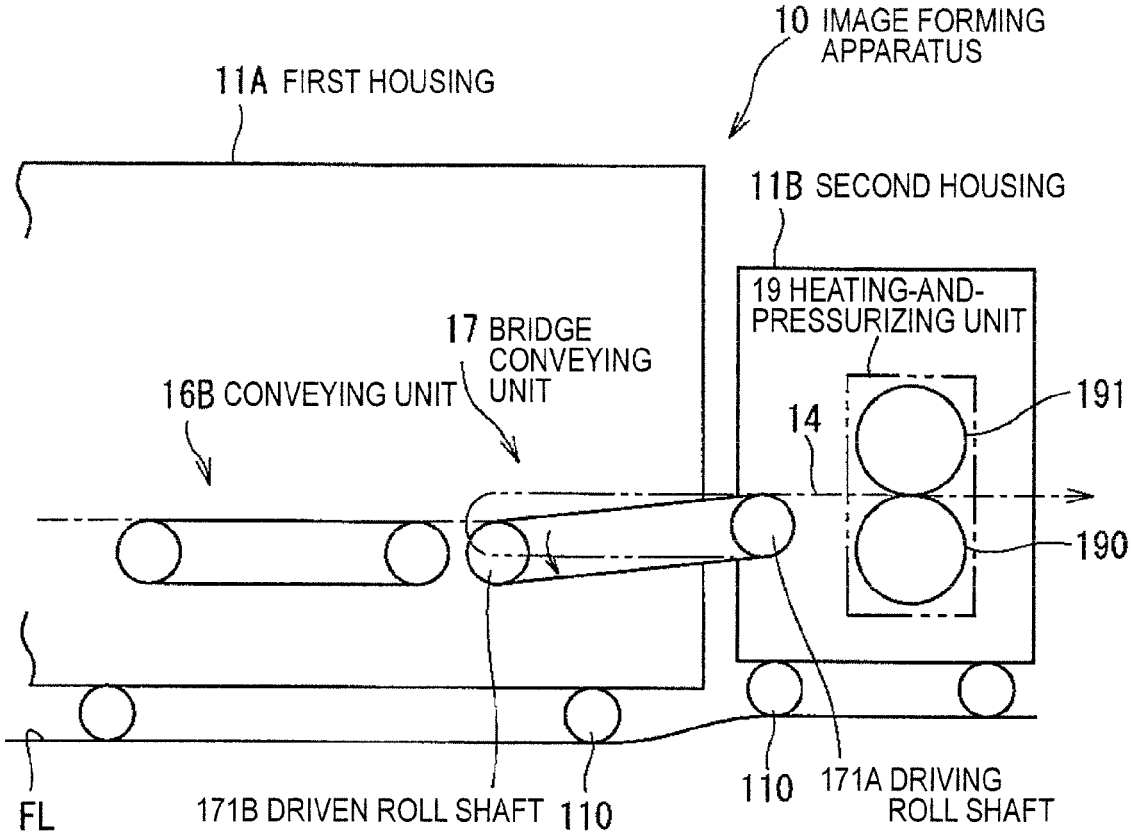
FIG. 3 is a plan view showing a first installation example of the image forming apparatus according to the embodiment of the invention.

FIG. 3 is a view showing a first installation example of the first and second housings 11A and 11B. In FIG. 3, for simplicity of description, the conveying unit 16C provided between the heating-and-pressurizing unit 19 and the bridge conveying unit 17 is not shown.

As shown in FIG. 3, for example, in the case in which the second housing 11B is provided in a higher position than the first housing 11A because a flat surface FL is warped, the second supporting member 174B shown in FIG. 2A is attached to the supporting member 40 in a position in which the driven roll shaft 171B of the bridge conveying unit 17 is rotated downward around the driving roll shaft 171A. As shown in FIG. 3, even if the flat surface FL is warped, relative positions of the driving roll shaft 171A and the heating-and-pressurizing unit 19 are not changed. Therefore, it is possible to prevent a wrinkle or a jam from occurring in the paper P.

Figure 4:
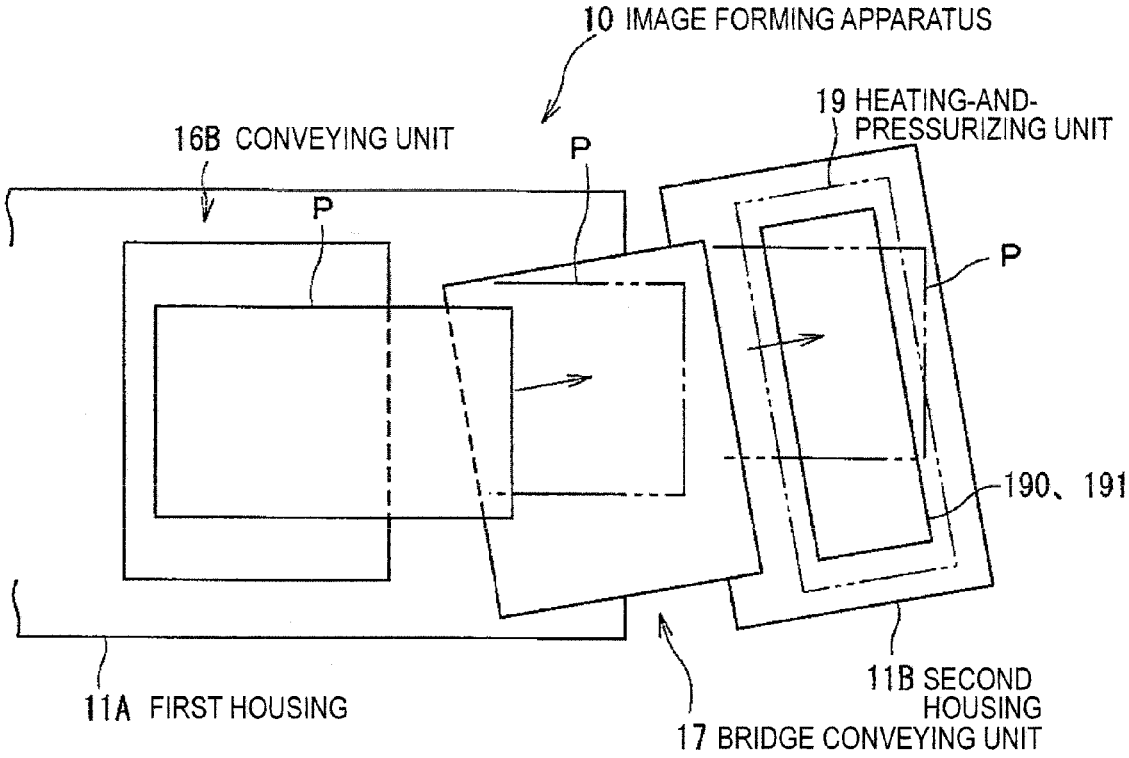
FIG. 4 is a plan view showing a second installation example of the image forming apparatus according to the embodiment of the invention.

FIG. 4 is a view showing a second installation example of the first and second housings 11A and 11B. In FIG. 4, for simplicity of description in the same manner as in FIG. 3, the conveying unit 16C provided between the heating-and-pressurizing unit 19 and the bridge conveying unit 17 is not shown.

As shown in FIG. 4, for example, in the case in which the second housing 11B is provided with a tilt in a horizontal direction with respect to the first housing 11A, the driven roll shaft 171B of the bridge conveying unit 17 is tilted to the supporting member 40 of the first housing 11A so that the second supporting member 174B is attached. As shown in FIG. 4, in the case in which the second housing 11B is provided with a tilt to the first housing 11A, a conveying direction of the paper P is changed in a transition to the bridge conveying unit 17 so that the paper P is moved into a conveying direction of the bridge conveying unit 17. The paper P is further conveyed by means of the bridge conveying unit 17 and vertically enters a nip region formed along shafts of the heating roll 190 and the pressurizing roll 191 in the heating-and-pressurizing unit 19. Consequently, it is possible to prevent a wrinkle or a jam from occurring in the paper P.

Next, description will be given to a summary of an operation of the image forming apparatus 10.

The papers P are fed one by one from a selected one of the paper feeding trays 12A and 12B to the paper conveying path 14 by means of the pickup roll 140 and the handling roll 141. The paper P fed to the paper conveying path 14 stands by in the registration roll 143.

Electrostatic latent images are formed on the surfaces of the photosensitive members 21Y, 21M, 21C and 21K by an irradiation of exposing lights emitted from the exposing devices 23Y, 23M, 23C and 23K. The electrostatic latent images are developed with the developers supplied from the developing devices 24Y, 24M, 24C and 24K so that developed images having the respective colors of Y, M, C and K are formed.

The developed images having the respective colors of Y, M, C and K are sequentially transferred to the intermediate transferring belt 33 which is circulated and moved, and reach the secondary transferring unit. The registration roll 143 is driven synchronously with a timing for transferring the developed images to the intermediate transferring belt 33, and the paper P is conveyed to the secondary transferring unit so that the developed images on the intermediate transferring belt 33 are transferred to the paper P.

Then, the paper P is conveyed to the bridge conveying unit 17 provided between the first and second housings 11A and 11B via the conveying units 16A and 16B disposed in the first housing 11A, and is conveyed to the conveying unit 16C provided in the second housing 11B by means of the bridge conveying unit 17 and is thus guided to the heating-and-pressurizing unit 19, and the developer images are fixed onto the paper P in the heating-and-pressurizing unit 19 and the paper P is thereafter discharged to the discharging tray 13.

The invention is not restricted to the embodiment but various changes can be made without departing from the scope of the invention.

What is claimed is:

1. An image forming apparatus comprising:

a first housing that includes an image forming unit for forming an image on a recording material;

a second housing that includes a heating unit for heating the image formed on the recording material;

a conveying unit that is provided across the first and second housings and conveys the recording material having the image formed thereon from a side of the image forming unit to a side of the heating unit using a no-end belt;

wherein the conveying unit includes:

a first fixed unit that is disposed on a side of the second housing of the conveying unit, and a second fixed unit that is disposed on a side of the first housing of the conveying unit;

a first fixing unit that positions the first fixed unit with respect to the heating unit, and fixes the first fixed unit to restrict movement in directions other than a rotating direction of the conveying unit around the first fixed unit; and a second fixing unit that is configured to rotate the conveying unit around the first fixed unit fixed to the first fixing unit, and fixes the second fixed unit to the first housing, wherein the first fixed unit is provided at a downstream side in a conveying direction of the recording material, and wherein the second fixed unit comprises a first supporting member and a second supporting member.

2. An image forming apparatus comprising:

a first housing that includes an image forming unit for forming an image on a recording material;

a second housing that includes a heating unit for heating the image formed on the recording material;

a conveying unit that is provided across the first and second housings and conveys the recording material having the image formed thereon from a side of the image forming unit to a side of the heating unit using a no-end belt;

wherein the conveying unit includes:

a first fixed unit that is disposed on a side of the second housing of the conveying unit, and a second fixed unit that is disposed on a side of the first housing of the conveying unit;

a first fixing unit that positions the first fixed unit with respect to the heating unit, and fixes the first fixed unit to restrict movement in directions other than a rotating direction of the conveying unit around the first fixed unit; and a second fixing unit that is configured to rotate the conveying unit around the first fixed unit fixed to the first fixing unit, and fixes the second fixed unit to the first housing, wherein:

the first fixed unit is provided at a downstream side in a conveying direction of the recording material, the second fixed unit comprises a first supporting member and a second supporting member, and the conveying unit is installed to be across the first and second housings by positioning the conveying unit into a space to insert, from the side of the first housing to the side of the second housing, the first fixed unit of the conveying unit into the bearing unit of the first fixing unit so that the first fixed unit butts the bearing unit so that the first fixed unit is prevented from moving in all directions within a plane, but one, and to fix, with a bolt, the second fixed unit of the conveying unit to a surface of a third supporting member.

* * * * *